US006226488B1

(12) United States Patent
Maeyama

(10) Patent No.: US 6,226,488 B1
(45) Date of Patent: May 1, 2001

(54) FIXING APPARATUS FOR CONTROLLING DISTANCE BETWEEN HEATING MEANS AND GUIDE MEMBER

(75) Inventor: Ryuichiro Maeyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/066,837

(22) Filed: Apr. 28, 1998

(30) Foreign Application Priority Data

May 7, 1997 (JP) ..... 9-134331

(51) Int. Cl.[7] ..... G03G 15/20

(52) U.S. Cl. ..... 399/322; 399/329; 399/400

(58) Field of Search ..... 399/322, 328–330, 399/341, 400; 219/216; 430/106.6–111; 432/60

(56) References Cited

U.S. PATENT DOCUMENTS

| | | | | |
|---|---|---|---|---|
| 5,345,300 | * | 9/1994 | Uehara et al. | 399/329 |
| 5,428,435 | * | 6/1995 | Yasuda et al. | 355/295 |
| 5,436,104 | * | 7/1995 | Yasuda et al. | 430/124 |
| 5,465,146 | * | 11/1995 | Higashi et al. | 399/328 |
| 5,608,508 | | 3/1997 | Kumagai et al. . | |
| 5,648,841 | * | 7/1997 | Yasuda et al. | 219/216 X |
| 5,666,623 | * | 9/1997 | Yamada et al. | 399/320 |
| 5,671,473 | * | 9/1997 | Yamada et al. | 399/320 |
| 5,714,736 | * | 2/1998 | Yoneda et al. | 219/216 |
| 5,747,213 | | 5/1998 | Okado et al. . | |
| 5,752,148 | * | 5/1998 | Yoneda et al. | 219/619 X |
| 5,771,434 | * | 6/1998 | Hokari | 399/400 |
| 5,794,105 | * | 8/1998 | Tamaoki et al. | 399/302 X |
| 5,797,070 | * | 8/1998 | Waki et al. | 403/109 X |
| 5,847,361 | * | 12/1998 | Yonekawa et al. | 219/216 |
| 5,890,047 | * | 3/1999 | Moser | 399/320 |
| 5,895,152 | * | 4/1999 | Ide et al. | 399/322 |

FOREIGN PATENT DOCUMENTS

| | | | |
|---|---|---|---|
| 36-10231 | | 5/1967 | (JP) . |
| 59-53856 | | 3/1984 | (JP) . |
| 59-61842 | | 4/1984 | (JP) . |
| 4-287078 | * | 10/1992 | (JP) . |
| 5-3333643 | * | 12/1993 | (JP) . |
| 6-67504 | | 3/1994 | (JP) . |
| 6-318001 | | 11/1994 | (JP) . |

OTHER PUBLICATIONS

Robert F. Fedors, A Method for Estimating Both the Solubility Parameters and Molar Volumes of Liquids, *Polymer Engineering and Science*, vol. 14, No. 2, Feb. 1974, published by The Society of Plastics Engineers, Inc., pp. 147–154.

* cited by examiner

*Primary Examiner*—William J. Royer
(74) *Attorney, Agent, or Firm*—Fitzpatrick, Cella, Harper & Scinto

(57) ABSTRACT

A fixing apparatus includes a fixing member and a heating unit. The fixing member forms a nip to convey a recording member which has an unfixed toner thereon. The toner on the recording medium is spherical. The heating unit is provided upstream of the nip in the moving direction of the recording medium, and does not come into contact with the recording medium. The fixing apparatus may include a control means for controlling the heat given from the heating unit to the recording medium.

19 Claims, 8 Drawing Sheets

$$SF1 = \frac{(MXLNG)^2}{AREA} \times \frac{\pi}{4} \times 100$$

$$SF2 = \frac{(PERI)^2}{AREA} \times \frac{1}{4\pi} \times 100$$

FIXING APPARATUS FOR CONTROLLING DISTANCE BETWEEN HEATING MEANS AND GUIDE MEMBER

BACKGROUND OF THE INVENTION

1. Field of the Invention

The present invention relates to fixing apparatuses of image forming apparatuses which form developed images on recording media by image forming processes, such as electrophotographic processes and electrostatic recording processes.

2. Description of the Related Art

Image forming apparatuses, such as electrophotographic copying machines, printers and facsimiles, include image forming means and heating means. The image forming means forms a developed image on a recording medium, such as an electrofacsimile sheet, an electrostatic recording sheet, a transfer sheet or printing paper, by a direct or indirect (transfer) method. The heating means fixes the developed image on the recording medium by heat and pressure.

A typical heating means which has been used in image forming apparatuses is a heating roller-type fixing apparatus, as shown in FIG. 12. Such a fixing apparatus has a pair of rollers and heaters provided inside the rollers, and fixes a toner image on a recording medium by heat and pressure when it passes through the rotating rollers.

When a toner formed by a polymerization process (hereinafter referred to as a polymeric toner) is fixed in such a fixing apparatus, the toner having high flowability transferred on a recording medium will diffuse by the shock when a recording medium passes through the rollers. The resulting image will therefore be disordered.

Control of the glossiness of the image is generally performed by changing the transfer speed of the recording medium passing through the roller or by changing the temperature of the heaters. A glossy image requires a longer fixing time. Accordingly the transfer speed should be reduced to form a highly glossy image. When the glossiness is controlled by changing the temperature of the heaters, an idling time is required until the heaters reach a temperature which is desirable for the glossiness of the next image. Accordingly, a change in glossiness requires such an idling time before fixing the next image.

SUMMARY OF THE INVENTION

An object of the present invention is to provide a fixing apparatus capable of preventing the formation of a disordered image caused by the shock of a recording medium when it is nipped between rollers.

Another object of the present invention is to provide a fixing apparatus capable of controlling the glossiness of an image without a change in fixing speed.

A further object of the present invention is to provide a fixing apparatus capable of controlling the glossiness of an image without changing the temperature of a heater.

A still further object of the present invention is to provide a fixing apparatus including a fixing member for forming a nip to transfer a recording member which has an unfixed toner on it, the toner being spherical, and a first heating unit provided upstream of the nip in the moving direction of the recording medium, the first heating unit not being in contact with the recording medium.

Another object of the present invention is to provide a fixing apparatus including a fixing member for forming a nip to transfer a recording member which has an unfixed toner on it, a first heating unit for heating the recording medium upstream of the nip in the moving direction of the recording medium, and a control means for controlling the heat given from the first heating unit to the recording medium.

Those objects together with others not specifically mentioned will become clear to those skilled in the art from the following description.

DESCRIPTION OF THE PREFERRED EMBODIMENT

Embodiment 1

Figure 1:
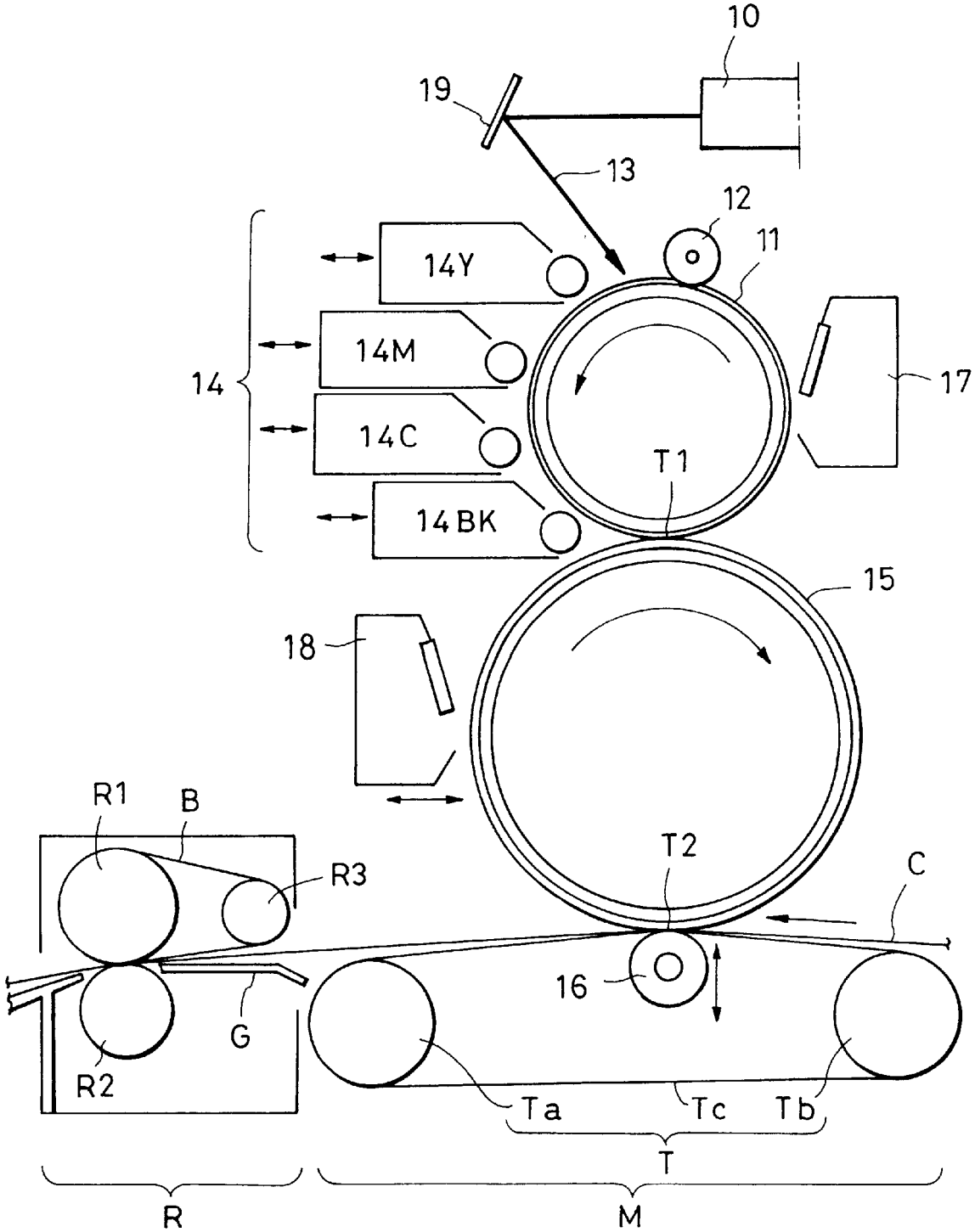
FIG. 1 is a schematic longitudinal cross-sectional view of an image forming apparatus in accordance with Embodiment 1.

FIG. 1 is a schematic cross-sectional view illustrating a configuration of a full-color electrophotographic printer as an image forming apparatus in accordance with the present invention. An electrophotographic photosensitive drum 11 includes a cylindrical substrate composed of aluminum or nickel, and a photosensitive layer which is composed of an organic photoconductor (OPC), amorphous selenium or amorphous silicon, and formed on the cylindrical substrate. The electrophotographic photosensitive drum 11 rotates counterclockwise at a given process speed (rotation rate) as shown by the arrow in the drawing. The electrophotographic photosensitive drum 11 is charged so as to have a given polarity and a given potential with a charger 12, such as charging roller during rotation. The charged surface of the electrophotographic photosensitive drum 11 is exposed to laser beams 13 from a laser scanner in response to the objective image information. The laser scanner 10 outputs modulated laser beams 13 in response to time series digital pixel signals of the image information which are submitted from an image signal generator such as an image reader not shown in the drawing. An electrostatic latent image is formed on the rotating photosensitive drum 11 in response to the image information after the scanning exposure.

In the formation of a full-color image, the latent image of a first separated color image component, for example, a yellow color image component is formed by the scanning exposure, and is developed to form a yellow toner image by a yellow developer 14Y in a four-colors developer 14. The yellow toner image is transferred onto a medial transfer drum 15 at the first transfer section T1 wherein the photosensitive drum 11 comes in contact with the medial transfer drum 15. The residual toner on the surface of the photosensitive drum 11 is removed with a cleaner 17.

A cycle of processes including charging, scanning exposure, developing, first transfer, and cleaning are repeated for a second separated color image component (for example, a magenta image component using a magenta developer 14M), a third separated color image component (for example, a cyan image component using a cyan developer 14C), and a fourth separated color image component (for example, a black image component using a black developer 14B). The yellow toner image, the magenta toner image, the cyan toner image and the black toner image are therefore overlapped with each other on the medial transfer drum 15 to form a color toner image in response to the objective full-color image.

The medial drum 15 includes a metallic drum, a medial resistance layer thereon, and a high resistance surface layer. The medial transfer drum 15 rotates clockwise in the direction of the arrow at substantially the same rotation rate as that of the photosensitive drum 11 while being in contact with or near the photosensitive drum 11. A bias potential is applied to the metallic drum of the medial transfer drum 15 so as to transfer the toner image on the photosensitive drum 11 onto the medial transfer drum 15.

The color toner image formed on the medial transfer drum 15 is transferred onto the recording medium C fed from a feeder not shown in the drawing to a second transfer section T2 as a nip section at which the rotating medial transfer drum 15 comes into contact with a transfer roller 16. The transfer roller 16 supplies charges having a reverse polarity to that of the toner from the rear surface of the recording medium C to transfer the combined color toner image on the medial transfer drum 15 onto the recording medium C.

The recording medium C with the toner image formed with the image forming means M is separated from the medial transfer drum 15 and introduced into an image heating unit (heat fixing apparatus) R. After the toner image is fixed by heat, the recording medium C with a full-color image is discharged to a discharging tray not shown in the drawing. This apparatus can also be used in a monochrome print mode.

Figure 2:
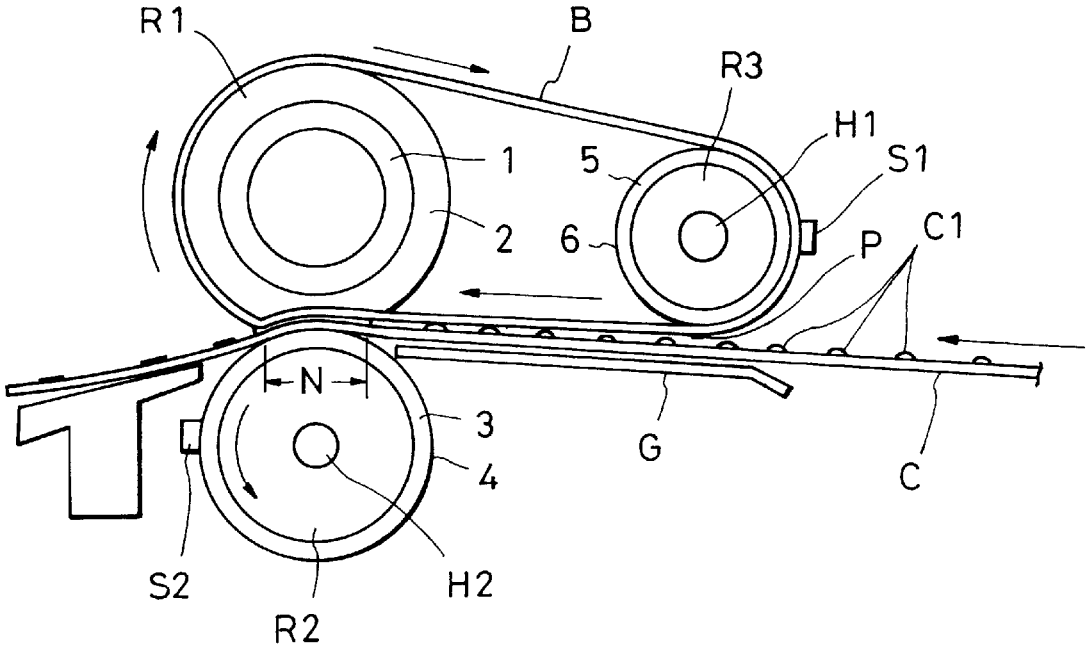
FIG. 2 is a schematic longitudinal cross-sectional view of a fixing apparatus in accordance with Embodiment 1.
Figure 3:
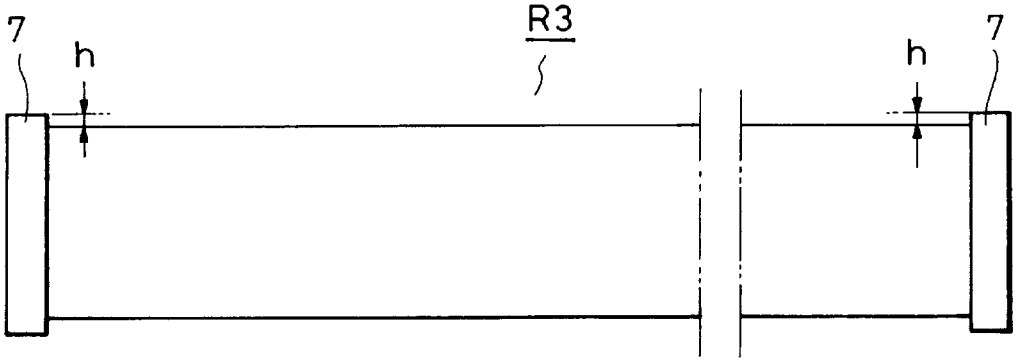
FIG. 3 is a schematic front cross-sectional view of R3 of the fixing apparatus shown in FIG. 2.
Figure 4:
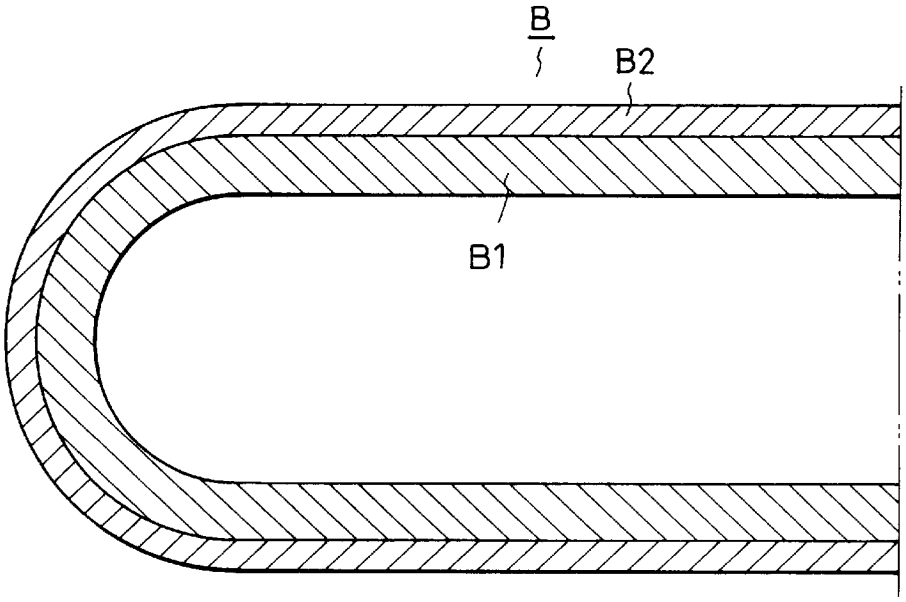
FIG. 4 is a schematic cross-sectional view of a fixing film in the fixing apparatus shown in FIG. 2.

The fixing apparatus R will now be described. FIG. 2 is a schematic longitudinal cross-sectional view of the fixing apparatus R, FIG. 3 is a schematic illustration of a heating roller R3 of the fixing apparatus, and FIG. 4 is a schematic cross-sectional view of a fixing film in the fixing apparatus shown in FIG. 2.

The fixing apparatus includes a fixing roller R1, a pressurizing roller R2, a heating roller R3, heaters H1 and H2 provided inside the heating roller R3 and the pressurizing roller R2, respectively, thermistors S1 and S2 as temperature controlling means, a guide G for supporting the recording medium, and a heating passage P, which is located upstream of the fixing nip in the moving direction of the recording medium, heats the recording medium with the transferred toner in a noncontact state.

The fixing roller R1 is composed of an aluminum core bar 1 with a diameter of 34 mm, and a heat resistant elastic cover layer 2 composed of a silicone rubber and having a thickness of 3 mm. The pressurizing roller R2 is composed of an aluminum core bar 3 with a diameter of 40 mm, and a heat resistant elastic cover layer 4 composed of a silicone rubber and having a thickness of 50 $\mu$m. The surface hardness of the heat resistant elastic cover layer 2 is the same as or smaller than that of the heat resistant elastic cover layer 4. The heating roller R3 is composed of an aluminum core bar 5 with a diameter of 40 mm and a Teflon cover layer 6 with a thickness of 30 $\mu$m, and is provided with step sections 7 having a thickness which is larger than the thickness of the fixing film B at both ends in order to prevent dislocation of the fixing film B as shown in FIG. 3 (a so-called stepped roller).

The fixing film B is an endless belt. The fixing film B includes an endless film base B1 composed of a metallic nickel with a thickness of 40 $\mu$m formed by electrocasting, and a silicone rubber releasing layer B2 with a thickness of 100 $\mu$m formed thereon as shown in FIG. 4. Alternatively, the fixing film B includes an endless film base B1 composed of a polyimide resin with a thickness of 55 $\mu$m and a silicone rubber releasing layer B2 with a thickness of 200 $\mu$m formed thereon. Preferably, the silicone rubber releasing layer B2 is covered with a coating layer of a fluorine resin, such as a tetrafluoroethylene-hexafluoropropylene (FEP) resin in order to improve the life span of the fixing film B. The fixing film B may contain a material emerging far infrared rays, e.g. ceramic, in order to enhance the heating efficiency of the fixing apparatus.

The heating roller R3 is provided with the main heater H1 therein, and the pressurizing roller R2 is provided with the auxiliary heater H2 therein. Also, the fixing roller R3 may be provided with an auxiliary heater, if necessary. The thermistor S1 comes into contact with the fixing film B in order to control the main heater H1, and the thermistor S2 comes into contact with the pressurizing roller R2.

As shown in FIG. 2, the metallic guide G for supporting the recording medium lies under and parallel to the fixing film B with an interval of 0.5 to 10 mm and extends from near the heating roller R3 to near the nip section N. The metallic guide G and the fixing film B forms a heating passage P which extends from near the heating roller R3 to the front of the nip section N and preheats the toner C1 and the recording medium C. The guide G is heated by radiation heat from the fixing film B when no recording medium passes through and preheats the recording medium when it passes through.

The pressurizing roller R2 applies pressure towards the fixing roller R1 with the fixing film B therebetween with a pressurizing means not shown in the drawing to form a nip section N. The fixing pressure at the nip section is set at 66 kgf.

The fixing film B is triboelectrically charged. It is therefore preferable that the surface of the fixing film B be a silicone rubber when a toner charged to a positive polarity is fixed or a fluorine rubber when a toner charged to a negative polarity is fixed. Such a selection of the surface of the fixing film can prevent adhesion of the unfixed toner onto the fixing film B because of electrostatic repulsion between the toner and the charged fixing film B. During the operation, the fixing film B moves lineally from the heating roll R3 to the nip section N at a moving speed of 133 mm/s which is the same as that of the recording medium C introduced from the image forming means M.

In such a configuration, heating of the main heater H1 is controlled based on signals from the thermistor S1 so as to maintain the temperature of the heating roller R3 at 150° C. to 170° C., the temperature of the fixing film B in the heating passage P at 145° C. to 165° C., and the temperature of the pressurizing roller R2 at the nip section N at 108° C. to 123° C. in order to achieve the preferred heat treatment.

The recording medium C introduced into the heating passage P with the transfer means T comes into contact with the guide G and moves accompanied by the guide G along the fixing film B, wherein the recording medium C is close to the fixing film B but is not in contact with the fixing film. During the moving step, the recording medium C and the unfixed toner C1 thereon are preheated by the radiation heat from the fixing film moving at the same speed and by the heat in the guide G accumulated when no recording medium passes through. The recording medium C comes into close contact with the fixing film B by a given pressure at the nip section N and is heated by the heat from the fixing film.

The preheating of the recording medium C and the toner C1 in the heating passage P can reduce the heat given to the recording medium C and the toner C1 at the nip section N, resulting in a reduced temperature at the nip section N. Since the fixing film B has a low heat capacity, the fixing film B heated with the heating roller R3 is cooled when passing through the heating passage P and the nip section N by heat transfer to the toner C1 and the recording medium C. The temperature of the fixing film B is significantly decreased at the rear end of the nip section N compared to heating rollers in conventional apparatuses. The fixing film B is therefore easily separable from the toner C1. Since the toner C1 in accordance with the present invention is formed by a polymerization process and encompasses wax (hereinafter referred to as a polymeric toner), the wax easily bleeds out by the heat in the heating passage P and the polymeric toner is easily separable from the fixing film B.

Such a configuration secures easy separation of the toner C from the fixing film B even when the apparatus is not provided with an oil coating mechanism supplying oil onto the outer periphery of the fixing film B, and thus provides a fixed image without offset. Since the preheated toner itself improves separation characteristics, the offset is prevented regardless of the amount of loaded toner.

The present inventors have conducted intensive study on the formation of a satisfactory image on an overhead transparent (OHT) sheet, and discovered that the formation of a coating layer of wax by toner melting can achieve a full-color OHT image having excellent transparency without toner offset at a low fixing temperature and can prolong the life of the pressurizing members.

Figure 5:
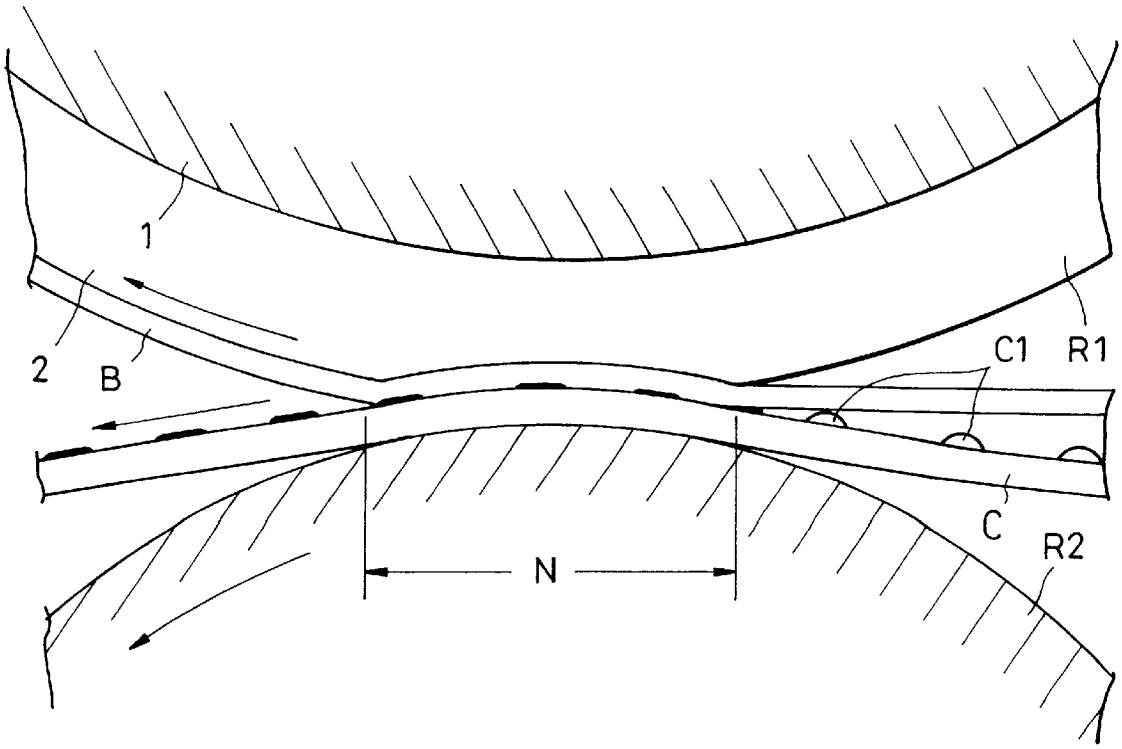
FIG. 5 is a cross-sectional view of the main section of the fixing apparatus shown in FIG. 2.

Since the surface hardness of the fixing roller R1 is the same as or lower than that of the pressurizing roller R2, a part of the pressurizing roller R2, as well as the fixing film B encroaches on the fixing roller R1 at the nip section N. The front edge of the recording medium C discharged from the nip section N therefore turns downward to the pressurizing roller R2, and a separation claw on the fixing film B is unnecessary (refer to FIG. 5).

In cold districts, insufficient heating of the pressurizing roller R2 will deteriorate fixing characteristics at the initial stage of the operation. The pressurizing roller R2 is therefore preheated to a given temperature with the auxiliary heater H2 based on the temperature detected with the thermistor S2. Also, the toner may be heated with the auxiliary heater H2 together with the main heater H1 during the fixing operation.

Dislocation of the fixing film B is corrected by the step sections 7 provided at both ends of the heating roller R3 as shown in FIG. 3 by means of stiffness of the fixing film B, wherein the step sections have a step of h which is not smaller than that of the fixing film B.

Figure 6:
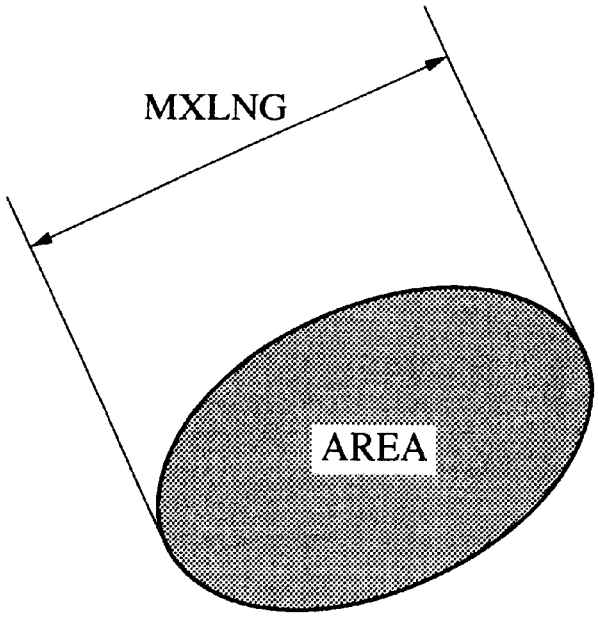
FIG. 6 is a schematic illustration of shape factors SF-1 and SF-2.
Figure 6:
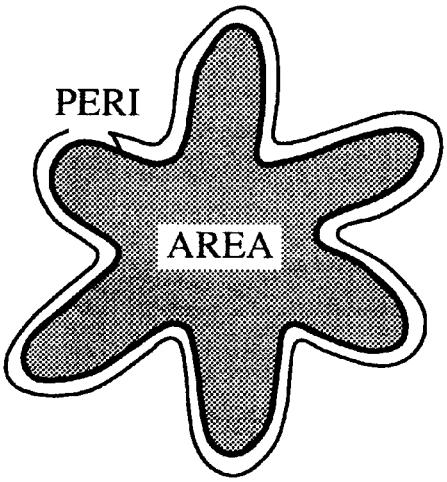

The toner used in this embodiment preferably has a spherical shape, defined by the shape factors, SF-1 and SF-2 represented by the following equations:

$$SF\text{-}1 = \frac{(MXLNG)^2}{AREA} \times \frac{\pi}{4} \times 100$$

$$SF\text{-}2 = \frac{(PERI)^2}{AREA} \times \frac{1}{4\pi} \times 100$$

wherein MXLNG is the maximum length of the toner particle, PERI is the perimeter of the particle, and AREA is a projective area of the particle as shown in FIG. 6. The shape factor SF-1 represents the sphericity of the toner and the shape factor SF-2 represents irregularity of the toner. It is preferable that the toner in accordance with this embodiment has an SF-1 value of 100 to 140 and an SF-2 value of 100 to 130 and more preferably 100 to 120. These shape factors SF-1 and SF-2 are determined as follows. One hundred toner images larger than 2 $\mu$m are extracted at random in a field enlarged to 1,000 times with an FE-SEM S-800 made by Hitachi, Ltd., and then calculated based on the above equations with an image analyzer Luzex III made by Nireco Corporation connected to the FE-SEM via an interface.

In the present invention, the toner having such shape factors is preheated in the heating passage P to cause deformation of the toner. The deformed toner has lower flowability and can prevent disorder of the image due to shock when the recording medium passes through the nip.

Figure 7:
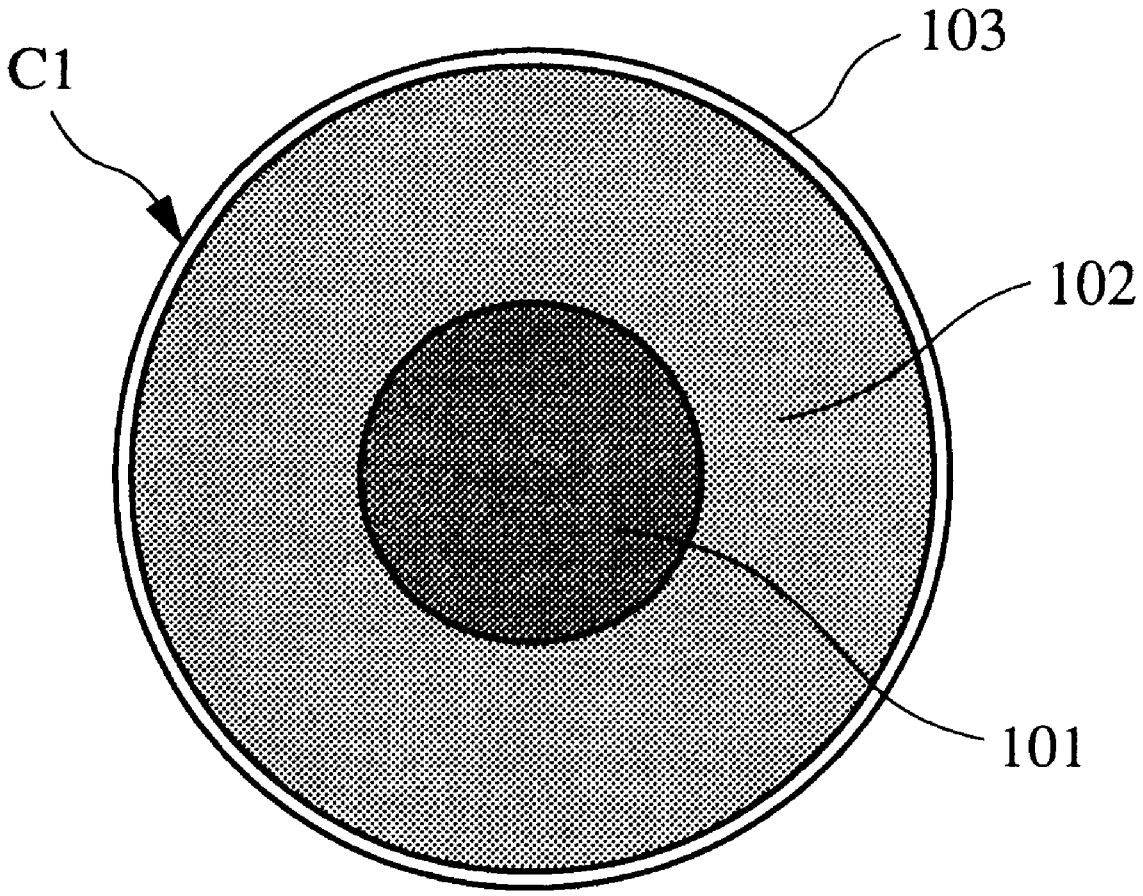
FIG. 7 is a cross-section of a toner enclosing wax.

As shown in FIG. 7, the toner C1 in this embodiment preferably has a capsule or core-shell structure in which wax 101 and a binding resin 102 as a core are encapsulated within a toner shell 103. The wax will easily bleed out from the toner with a reduced heat at the nip section by preheating the toner in the heating passage P. In such a toner configuration, it is preferable that the glass transition temperature of the shell be higher than the melting point of the wax 101 and the glass transition temperature of the binding resin 102. Further, it is preferable that the melting point of the wax 101 be lower than the surface temperature of the recording medium in the heating passage P.

The toner used in this embodiment will now be described in detail.

It is preferable that the wax contained in the toner as a releasing agent has a moderate affinity with the binding resin, a high hydrophobic property, and a low melting point, in order to achieve excellent fixing characteristics and high offset resistance. Also preferably, the wax has at least two shoulders and/or peaks in its molecular weight distribution curve, a weight average molecular weight (Mw) of 400 to 4,000, and a number average molecular weight (Mn) of 200 to 4,000. Such a molecular weight distribution may be achieved with a single type or different types of waxes. The molecular weight distribution inhibits crystallization of the waxes. Blending two or more types of waxes is performed without limitation. For example, the waxes are blended in a media dispersion mixer, such as a ball mill, sand mill, attritor, apex mill, or hand mill by melting the waxes at a temperature higher than the melting points of these waxes. Alternatively, the waxes are mixed and blended with a polymerizable monomer in a media dispersion mixer. A pigment, a charging modifier and a polymerization initiator may be used as additives.

In the present invention, the molecular weight distribution of the wax is determined under the following conditions:

Instrument: GPC-150C (made by Waters Ltd.)

Column: Two GMH-HT (30 cm) in series (made by Tosoh Corporation)

Temperature: 135° C.

Solvent: o-dichlorobenzene (0.1% of ionol is added)

Flow rate: 1.0 ml/min.

Injection Volume: 0.4 ml (concentration of the sample: 0.15%)

The molecular weight is calculated according to a calibration curve made with monodisperse polystyrene standard samples, and converted into an equivalent molecular weight of polyethylene using a Mark-Houwink viscosity equation.

The weight average molecular weight (Mw) of the wax ranges preferably from 400 to 4,000, more preferably from 450 to 3,500, and most preferably from 500 to 3,000. The number average molecular weight (Mn) of the wax ranges preferably from 200 to 4,000, more preferably from 200 to 3,500, and most preferably from 250 to 3,000. When the Mw is less than 400 or the Mn is less than 200, blocking resistance of the toner will deteriorate. On the other hand, when the Mw or the Mn is higher than 4,000, the wax will lose transparency because of increased crystallizability.

It is preferable that 1 to 40 parts by weight and more preferably 2 to 30 parts by weight of wax be added to 100 parts by weight of the binding resin. In a dry toner production process in which a mixture of a binding resin, a coloring agent and a wax is melted, pulverized after cooling, and classified to obtain toner particles, it is preferable that 1 to 10 parts by weight and more preferably 2 to 7 parts by weight of wax be added to 100 parts by weight of the binding resin. In a polymerization toner production process in which a polymerizable monomer containing a coloring agent and a wax is polymerized to obtain directly toner particles, it is preferable that 2 to 40 parts by weight, more preferably 5 to 30 parts by weight, and most preferably 5 to 30 parts by weight of wax be added to 100 parts by weight of the polymerizable monomer. In the polymerization toner production process, the wax has a lower polarity than that of the binding resin, hence a larger amount of wax can be encapsulated in the toner particles during the polymerization process in an aqueous solvent compared with the dry process. The toner particles by the polymerization process are therefore more effective in prevention of offset in the fixing process. When the wax content is less than the above-mentioned lower limits, the offset will not be effectively prevented. On the other hand, a wax content higher than the above-mentioned upper limits causes decreased blocking resistance and offset resistance, and melt-adhesion of the toner on the drum and the sleeve. Further, the toner by the polymerization process tends to have a broader particle size distribution when a high content of wax is added.

It is preferable that the crystallizability of the wax in the toner be decreased for obtaining a satisfactory OHP image in a fuser with a low heat capacity. Irregular reflection will occur at the interface between unmelted toner particles after fixing or by a difference in refractive index between the toner layer and the wax releasing-agent layer formed thereon during the fixing process. Such irregular reflection deteriorates the brilliance of the projected image and the color brightness. These disadvantages are more noticeable in a transmission overhead projector than a reflection overhead projector.

It is preferable that the binding resin has a low glass transition temperature (Tg); otherwise, unmelted toner particles after the fixing process will form undesirable interfaces. It is preferable to use a wax having a low enthalpy of melting (ΔH) which can be rapidly melted by a low thermal energy. It is preferable to adjust a difference in solubility parameter (SP) between the binding resin and wax to a moderate value in order to rapidly form a releasing layer of the melted wax between the binding resin layer and the fixing film.

Preferable features in accordance with this embodiment will now be described in consideration of these facts.

A binding resin, such as a polyester resin, a styrene-acrylic resin, an epoxy resin, or a styrene-butadiene resin is generally used in the toner. It is preferable that the wax has a refractive index that is near that of the binding resin used together with the wax. The refractive indices of the wax and binding resin are determined as follows. A solid sample with a length of 20 mm to 30 mm, a width of 8 mm and a thickness of 3 mm to 10 mm is prepared. A small amount of bromonaphthalene is applied onto a given surface of a prism and the solid sample is placed thereon. The refractive index of the sample is determined with, for example, Abbe refractometer 2T made by Atago Co., Ltd. It is preferable that the difference in diffraction index In between the binding resin and the wax be 0.18 or less and more preferably 0.10 or less at 25° C. A difference of larger than 0.18 causes a significant decrease in transparency of the OHP image. In particular, the projected half-tone image has low brilliance.

The wax used in this embodiment has a melting point of preferably 30° C. to 150° C. and more preferably 50° C. to 120° C. A toner containing a wax with a melting point of less than 30° C. will cause decreased blocking resistance and contamination of the sleeve and the photosensitive member after repeated copying operation. When the toner is produced by a pulverization process using a wax with a melting point of higher than 150° C., a large amount of energy is required for achieving homogeneous mixing of the wax and the binding resin. On the other hand, the wax preferably has a melting point of less than 100° C. in the polymerization toner production process; otherwise the viscosity of the mixture will significantly increase during the polymerization. As a result, it is difficult to contain a large amount of wax in the toner because of the limited miscibility. A large reactor is required for solving such problems.

The solubility parameter (SP) described below is calculated by the Fedors' method by means of the additive property of SP values of atomic groups (described in *Polym. Eng. Sci.,* 14(2), 147 (1974)). The wax used in this embodiment preferably has an SP value in a range from 7.5 to 9.7. A wax with an SP value of less than 7.5 has poor miscibility with a binding resin; hence the wax is not satisfactorily dispersed into the binding resin. Thus, the wax easily adheres to the developing sleeve during the repeated copying operation, resulting in a change in a charging state of the toner. Further, fogging and a change in density when the toner is supplied will easily occur. The use of a toner with an SP value of higher than 9.7 will cause blocking of toner particles during long-term storage. Such a wax has high compatibility with the binding resin and thus prevents the satisfactory formation of the wax releasing layer during the fixing process, resulting in offset.

The melting viscosity of the wax used in this embodiment is determined with, for example, a viscometer VT-500 made by HAAKE with a cone plate rotor PK-1. The melting viscosity at 100° C. of the wax is preferably 1 to 50 mPas·sec and more preferably 3 to 30 mPas·sec. A melting viscosity of less than 1 mPas·sec will easily cause contamination of the sleeve due to mechanical shear stress when a thin toner layer is coated on the sleeve with a blade in a nonmagnetic one-component developing process. Also, in a two-component developing process, shear stress between the toner and a carrier will cause embedding of the other additives and breakage of the toner. A melting viscosity of higher than 50 mPas·sec causes an excessive viscosity of the dispersion in the polymerization toner production process. Thus, the resulting toner has a spreading particle size distribution.

The hardness of the wax is determined with, for example, a Shimadzu dynamic microhardness tester DUH-200. Using a Vickers tip, the tip under a load of 0.5 g is displaced by 10 Mm into a sample at a loading rate of 9.67 mg/sec and is held for 15 seconds. The Vickers hardness is determined by observing the trace of the tip. The sample used in the hardness determination is columnar with a diameter of 20 mm and a thickness of 5 mm and is prepared by casting of the melted wax. The wax in this embodiment has a hardness in a range preferably from 0.3 to 5.0 and more preferably from 0.5 to 3.0. A toner containing a wax with a Vickers hardness of less than 0.3 is easily broken at the cleaning section in the copying machine. The damaged toner will fuse and adhere to the drum surface, and thus black lines will form on the image. When a plurality of sheets after the copying operation are stacked, the toner is easily transferred onto the rear face of the adjoining sheet. A toner containing a wax with a Vickers hardness of higher than 5.0 requires a significantly high pressure applied to the fuser in the fixing process, hence the fuser must have a sufficiently high mechanical strength. If an ordinary pressure is applied to the fuser, offset resistance is decreased.

The wax has a crystallinity of preferably 10 to 50% and more preferably 20 to 35%. A crystallinity of less than 10% will cause deteriorated preservability and decreased flowability of the toner. On the other hand, a crystallinity of higher than 50% causes a decreased transparency of the OHP image. The crystallinity in this embodiment is determined by the following equation from the ratio of a crystalline diffraction peak area to the total peak area including the amorphous halo peak without using a calibration curve:

$$\text{Crystallinity} = \frac{\text{Area of the crystal peaks}}{\text{Area of the total peaks}} \times 100$$

The crystallinity is measured with, for example, a Rotorflex RU300 made by Rigaku Denki Co., Ltd. with a Cu target through a point focus at an output of 50 kV and 250 mA. The measurement is performed by a transmission/rotation mode with $2\theta=5°$ to $35°$.

Examples of methods for making the ester wax preferably used in this embodiment include an oxidation process, a synthetic process from a carboxylic acid or its derivative, and an ester-group-introducing reaction such as the Michael addition reaction. A preferred method for making the ester wax used in this embodiment is the condensation of a carboxylic acid with an alcohol or the reaction of an acid halide with an alcohol in view of high versatility of possible raw materials and high reactivity.

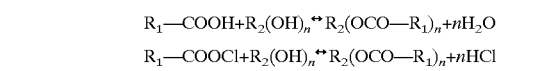

$$R_1\text{—}COOH + R_2(OH)_n \leftrightarrow R_2(OCO\text{—}R_1)_n + nH_2O$$

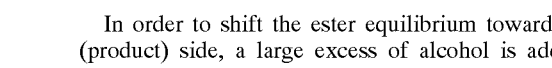

$$R_1\text{—}COOCl + R_2(OH)_n \leftrightarrow R_2(OCO\text{—}R_1)_n + nHCl$$

In order to shift the ester equilibrium towards the right (product) side, a large excess of alcohol is added or the reaction is performed in an aromatic solvent which forms an azeotropic mixture with water using a Dean-Stark water separator. Alternatively, a combination of an acid halide and a base as an acceptor of the acid by-product may be employed in the reaction for forming the polyester wax in the aromatic solvent.

Next, the binding resin used in the toner in accordance with this embodiment will be described.

In order to prompt the deformation of the toner particles in the heating passage P, the binding resin when passing through the heating passage P has preferably a melting viscosity of $1\times10^6$ cp or less. Examples of binding resins preferably used in this embodiment include styrene homopolymers, e.g. polystyrene, poly-p-chlorostyrene and polyvinyltoluene; styrene copolymers, e.g. styrene-p-chlorostyrene copolymers, styrene-vinyltoluene copolymers, styrene-ninylnaphthalene copolymers, styrene-acrylic ester copolymers, styrene-methacrylic ester copolymers, styrene-α-chloromethacrylic ester copolymers, styrene-acrylonitrile copolymers, styrene-vinyl methyl ether copolymers, styrene-vinyl methyl ketone copolymers, styrene-butadiene copolymers, styrene-isoprene copolymers, and styrene-acrylonitrile-indene copolymers; and miscellaneous polymers, e.g. polyvinyl chloride, phenol resins, natural resin-modified phenol resins, natural resin-modified maleic resins, acrylic resins, methacrylic resins, polyvinyl acetate, silicone resins, polyester resins, polyurethanes, polyamide resins, furan resins, epoxy resins, xylene resins, polyvinyl butyral, terpene resins, coumarone-indene resins, and petroleum resins. Preferred binding resins are, for example, styrene copolymers and polyester resins.

Examples of comonomers reacting with the styrene monomer in the styrene copolymers include monocarboxylic acids having a double bond and derivatives thereof, e.g. acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, e.g. maleic acid, butyl maleate, and dimethyl maleate; vinyl esters, e.g. vinyl chloride, divinyl oxide, and vinyl benzoate; ethylenic olefins, e.g. ethylene, propylene, and butylene; vinyl ketones, e.g. vinyl methyl ketone and vinyl hexyl ketone; and vinyl ethers, e.g. vinyl methyl ether, vinyl ethyl ether, and vinyl isobutyl ether. These comonomers may be used alone or in combination.

The component of the binding resin in this embodiment soluble in tetrahydrofuran (THF) preferably has a number average molecular weight of 3,000 to 1,000,000. The styrene homopolymers and copolymers may be crosslinked. A mixture of styrene homopolymers and copolymers may also be used.

Crosslinkers for the binding resin may be compounds having at least two double bonds participating in crosslinking. Examples of such compounds include aromatic divinyl derivatives, e.g. divinyl benzene and divinyl naphthalene; carboxylate esters having two double bonds, e.g. ethylene glycol acrylate, ethylene glycol dimethacrylate, and 1,3-butanediol dimethacrylate; divinyl compounds e.g. divinylaniline, divinyl ether, divinyl sulfide, and divinyl sulfone; and vinyl compounds having three or more vinyl groups. These compounds may be used alone or in combination. The preferable content of the crosslinker ranges from 0.001 to 10 parts by weight to 100 parts by weight of the polymerizable monomer.

The toner in this embodiment may contain a charging controller. Examples of materials imparting effectively a negative charge to the toner include organometallic compounds and chelate compounds, e.g. monoazo metallic compounds, acetylacetone metallic compounds, aromatic hydroxy-carboxylic acids, and aromatic dicarboxylic acids. Examples of other materials include aromatic hydroxy-carboxylic acids, aromatic mono- and poly-carboxylic acids, and salts, anhydrides, and esters thereof, and phenol derivatives such as bisphenol. Further, examples of materials used in this embodiment include urea derivatives, metal-containing salicylic acid compounds, metal-containing naphthoic acid compounds, boron compounds, quaternary ammonium salts, calixarene, silicon compounds, styrene-acrylic acid copolymers, styrene-methacrylic acid copolymers, styrene-acrylic acid-sulfonic acid copolymers, and nonmetal carboxylic acid compounds.

Examples of materials imparting a positive charge to the toner include nigrosine and its derivatives with metal salts of fatty acids; guanidines; imidazoles; quaternary ammonium compounds, such as tributylbenzyl ammonium-1-hydroxy-4-naphthosulfonate and tetrabutyl ammonium tetrafluoroborate; onium salts, such as phosphonium salts, and lake pigments thereof; triphenylmethane dyes and lake pigments thereof (examples of laking agents include phosphotungustic acid, phosphomolybdic acid, phosphotungstomolybdic acid, tannic acid, lauric acid, gallic acid, ferricyanides, and ferrocyanides); metal salts of higher fatty acids; dialkyltin oxides, e.g. dibutyltin oxide, dioctyltin oxide, and dicyclohexyltin oxide; and dialkyltin borates, e.g. dibutyltin borate, dioctyltin borate, and dicyclohexyltin borate. These materials may be used alone or in combination. Among them, nigrosine compounds and quaternary ammonium salts are preferably used.

These charge controllers may be added in an amount of preferably 0.01 to 20 parts by weight and more preferably 0.5 to 10 parts by weight to 100 parts by weight of the resinous components.

The black coloring agent in this embodiment is composed of a magnetic material, and a black coloring mixture of yellow/magenta/cyan coloring agents.

Examples of yellow coloring agents include condensed azo compounds, isoindolinone compounds, anthraquinone compounds, azo metallic complexes, methine compounds, and allylamide compounds. Preferable examples of such compounds include C.I. Pigment Yellows 12, 13, 14, 15, 17, 62, 74, 83, 93, 94, 95, 109, 110, 111, 128, 129, 147, 168 and 180.

Examples of magenta coloring agents include condensed azo compounds, diketopyrrolopyrrole compounds, anthraquinone compounds, quinacridone compounds, lake basic dyes, naphthol compounds, benzimidazolone compounds, thioindigo compounds Be and perylene compounds. Preferable examples of such compounds include C.I. Pigment Reds 2, 3, 5, 6, 7, 23, 48:2, 48:3, 48:4, 57:1, 81:1, 144, 146, 166, 169, 177, 184, 185, 202, 206, 221 and 254.

Examples of cyan coloring agents include copper phthalocyanine compounds, anthraquinone compounds, and lake basic dyes. Preferable examples of such compounds include C.I. Pigment Blues 1, 7, 15, 15:1, 15:2, 15:3, 15:4, 60, 62 and 66.

These coloring agents can be used alone or in combination as a mixture or a solid solution. These coloring agents are selected in view of hue angle, color saturation, brilliance, weatherability, transparency of the OHP image, and dispensability in the toner. The coloring agents are added in an amount of 1 to 20 parts by weight to 100 parts by weight of the resin.

The toner in this embodiment may contain a magnetic material when it is used as a magnetic toner. The magnetic material may function as a coloring agent. Examples of magnetic materials include iron oxides, e.g. magnetite, hematite, and ferrite; metals, e.g. iron cobalt, and nickel; and alloys and mixtures of these metals with other metals, e.g. aluminum, cobalt, copper, lead, magnesium, tin, zinc, antimony, beryllium, bismuth, cadmium, calcium, manganese, selenium, titanium, tungsten, and vanadium.

It is preferable that a surface-modified magnetic material be used in this embodiment. The polymerization toner is subjected to hydrophobic treatment with a surface modifier which does not inhibit polymerization. Examples of such modifiers include silane coupling agents and titanium coupling agents.

The magnetic material has an average particle size of preferably 2 $\mu$m or less, and more preferably 0.1 $\mu$m to 0.5 $\mu$m. It is preferable that the magnetic material be added in an amount of 40 to 150 parts by weight to 100 parts by weight of the resinous component. Further, the magnetic material preferably has a coercive force (Hc) of 20 to 30 Oersteds, a saturation magnetization (as) of 50 to 200 emu/g, and remanent magnetization (or) of 2 to 20 emu/g at an applied magnetic field of 10 K Oersteds.

The particle size of the additives for imparting various characteristics to the toner is preferably one-fifth or less the volume average size of the toner particles in view of the durability of the additives in the toner. The particle size means an average particle size of toner particles determined by surface observation of the toner particles with an electron microscope. Examples of these additives include flowability improvers, abrasive agents, lubricants, and charging controlling particles.

Examples of flowability improvers include metal oxides, e.g. silicon oxide, aluminum oxide and titanium oxide;

carbon black; and fluorocarbons. It is preferable that such flowability improvers be subjected to hydrophobic treatment.

Examples of abrasive agents include metal oxides, e.g. strontium titanate, cerium oxide, aluminum oxide, magnesium oxide and chromium oxide; nitrides, e.g. silicon nitride; carbides, e.g. silicon carbide; and metal salts, e.g. calcium sulfate, barium sulfate and calcium carbonate.

Examples of lubricants include fluorine resin powders, e.g. polyvinylidene fluoride and polytetrafluoroethylene; and metal salts of fatty acids, e.g. zinc stearate and calcium stearate.

Examples of charging controlling particles include metal oxides, e.g. tin oxide, titanium oxide, zinc oxide, silicon oxide, aluminum oxide; and carbon black.

These additives are added in an amount of 0.1 to 10 parts by weight and preferably 0.1 to 5 parts by weight to 100 parts by weight of toner particle. These additives may be used alone or in combination.

The toner in this embodiment may be used for one-component and two-component developers. For example, in a one-component developer of a magnetic toner containing a magnetic material, the magnetic toner is simultaneously transferred and charged by means of a magnet stored in a developing sleeve. When using a nonmagnetic toner containing no magnetic material, the toner is forcibly subjected to triboelectric charge on the developing sleeve using a blade and a fur brush to retain the toner on the sleeve for transfer.

In a generally used two-component developer, the toner in this embodiment is used together with a carrier. The carriers used in this embodiment are single or complex ferrite composed of iron, copper, zinc, nickel, cobalt, manganese, and/or chromium. Other carriers may also be used. The shape of the carrier is important in view of control of saturation magnetization and electrical resistance within wide ranges. Examples of the shapes of the carrier include spherical, flat and amorphous shapes. It is preferable that the fine structure, for example, unevenness on the carrier surface be controlled. In general, carrier core particles are formed by firing and granulating an inorganic oxide, and coated with a resin to form a carrier. In order to decrease the load of the carrier to the toner, a low-density dispersed carrier may be prepared by pulverizing and classifying a blend of an inorganic oxide and resin, or a spherical dispersed carrier may be prepared by suspension polymerization of a mixture of a monomer and an inorganic oxide in an aqueous solvent.

It is preferable that the carrier be coated with a resin. The resin coating layer is formed by a known process, for example, applying a solution or suspension containing a coating material such as a resin onto the carrier or by blending the carrier particles and resin particles.

Nonlimiting examples of materials adhered onto the carrier particles include polytetrafluoroethylene, polymonochlorotrifluoroethylene, polyvinylidene fluoride, silicone resins, polyester resins, metal di-tert-butyl salicylates, styrene resins, acrylic resins, polyamides, polyvinyl butyral, nigrosine, aminoacrylate resins, basic dyes and lakes thereof, fine silica powder, and fine aluminum powder. These may be used alone or in combination.

These materials are used in an amount of 0.1 to 30 percent by weight and preferably 0.5 to 20 percent by weight of the carrier. The carrier has an average particle size of 10 $\mu$m to 100 $\mu$m and preferably 20 $\mu$m to 50 $\mu$m.

In the most preferable embodiment, the carrier is a coated ferrite carrier which is composed of ferrite, and its surface is coated with a mixture of a fluorine resin and a styrene resin, for example, a 90:10 to 20:80 and preferably 70:30 to 30:70 mixture of polyvinylidene fluoride and styrene-methyl methacrylate; polytetrafluoroethylene and styrene-methyl methacrylate; or a fluorine copolymer and a styrene copolymer; or with a silicone resin, in which the amount of the coated resin is 0.01 to 5 percent by weight and preferably 0.1 to 1 percent by weight of the ferrite. Typical examples of the fluorine copolymer include vinylidene fluoride-tetrafluoroethylene copolymers (10:90 to 90:10). Examples of styrene copolymers include styrene-2-ethylhexyl acrylate copolymers (80:20 to 20:80) and terpolymers of styrene (20 to 60), 2-ethylhexyl acrylate (5 to 30) and methyl methacrylate (10 to 50).

The above-mentioned coated ferrite carrier has a narrow distribution of particle sizes, imparts satisfactory triboelectric discharging characteristics to the toner in accordance with the present invention, and improves electrophotographic characteristics.

In the preparation of the two-component developer containing the toner and the carrier in this embodiment, the concentration of the toner in the developer exhibiting satisfactory results ranges from 2 to 15 percent by weight and preferably from 4 to 13 percent by weight. A concentration of the toner of less than 2 percent by weight causes formation of a low-density image that is unsuitable for practical use. On the other hand, a concentration of higher than 15 percent by weight causes fogging and spattering in the copying machine and deterioration of the life span of the developer.

Preferably the carrier has the following magnetic characteristics. A required saturation magnetization ranges from 20 to 90 $Am^2/kg$, and preferably 30 to 70 $Am^2/kg$ for obtaining higher quality images. No high quality image is obtained at a saturation magnetization of higher than 90 $Am^2/kg$. On, the other hand, adhesion of the carrier will easily occur due to weak magnetic force at a saturation magnetization of less than 20 $Am^2/kg$.

In the production of the toner in this embodiment including a pulverization process, a binding resin, an ester wax, a pigment or dye as a coloring agent, a magnetic material, and optionally charging controller and other additives are thoroughly blended in a mixer, such as a Henschell mixer or ball mill, and melt-kneaded with a hot roller, a kneader or an extruder. The metallic compound, pigment, dye and magnetic material are dispersed or dissolved in the resinous melt. The toner is prepared from the melt through cooling, solidifying, pulverization, shaping into a sphere, shell formation, and classification processes.

A toner for developing electrostatic latent images is prepared by thoroughly mixing the above-mentioned toner with desired additives in a mixer such as a Henschell mixer. Methods for preparing the polymerization toner used in this embodiment are disclosed in, for example, Japanese Patent Publication No. 56-13945 in which a melted mixture is atomized into air through a disk nozzle or a multinozzle to obtain spherical toner particles; and Japanese Patent Publication No. 36-10231, and Japanese Patent Laid-Open Nos. 59-53856 and 59-61842, in which toner particles are directly formed by suspension polymerization. The toner particles are also produced by direct dispersion polymerization in an aqueous organic solvent which can dissolve the monomer but cannot dissolve the polymer; by direct emulsion polymerization such as soap-free polymerization in the presence of an aqueous polar initiator; and by hetero-aggregation of primary particles having a polarity by emulsion polymerization with polar particles having a reversed polarity.

Although the toner by the dispersion polymerization has a significantly narrow particle size distribution, usable raw materials are limited and a complicated reactor is required in view of disposal of the flammable solvent and the wasted solvent. The toner by the emulsion polymerization such as the soap-free polymerization also has a relatively narrow particle size distribution; however, the toner, which contains the emulsifier and the moiety of the initiator on its surface, has deteriorated environmental characteristics.

In this embodiment, suspension polymerization under pressure is preferred since a fine particulate toner having a narrow particle size distribution can be easily prepared. Seed polymerization is also preferred in which monomers are adsorbed on the resulting polymer particles and are polymerized.

The preferable toner in this embodiment is prepared by direct polymerization and has a core-shell structure including an ester wax core and a resinous shell. A content of ester wax as the core material is preferable in view of excellent fixing characteristics. In encapsulation of the ester wax, a small amount of resin or monomer having high polarity is added to an aqueous solvent containing the ester wax having a smaller polarity than that of the main monomer. The resulting toner has a so-called core-shell structure in which the ester wax is surrounded with the-shell resin. The particle size and size distribution are controlled by changing the type or content of the water-insoluble inorganic salt or the dispersant functioning as a protective colloid, or by controlling the operational conditions of the reactor, for example, the rotation of the rotor, the path, stirring condition such as the shape of the stirrer, the shape of the reactor, and the content of the solid components in the aqueous solution.

The cross-section of the toner is observed with a transmission microscope (TEM). Toner particles are dispersed into a cold-setting liquid epoxy resin and the resin is hardened at 40° C. for 2 days. The hardened resin is stained with ruthenium tetraoxide and optionally osmium tetraoxide. A thin specimen is prepared from the stained sample with a microtome provided with a diamond knife and observed with the TEM. Staining of the specimen with ruthenium tetraoxide is preferred in order to achieve a high contrast between the ester wax core and the resinous shell, which is caused by a difference in crystallinity between these layers.

The toner is produced by the direct polymerization as follows. An ester wax, a coloring agent, a charging controller, an initiator and other additives are added to a monomer, and the solutes are homogeneously dispersed into the monomer with a homogenizer or an ultrasonic dispersion mixer. The monomer system is dispersed into an aqueous phase containing a dispersion stabilizer with a homomixer or homogenizer. The stirring speed and time are adjusted so as to form monomer droplets having a desired range of particle size corresponding to the size of the toner particle. After forming the monomer droplets, the stirring speed is decreased as far as sedimentation of the droplets does not occur, while the monomers are polymerized at a temperature of 40° C. or more, and more specifically 50° C. to 90°C. The temperature may be increased at the second-half stage in the polymerization. A part of the aqueous solvent may be removed from the reaction system at the final stage or after the reaction in order to remove unreacted monomers and by-products which will smell in the fixing process of the toner. After the reaction, the toner particles are washed, filtrated, and dried. In the general suspension polymerization process, it is preferable that 300 to 3,000 parts by weight of water be used as a dispersing medium to 100 parts by weight of the monomer system.

Examples of polymerizable monomers used in the direct toner production process include styrene monomers, e.g. styrene, o-, m-, and p-methylstyrenes, m- and p-ethylstyrenes; acrylate monomers, e.g. methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate, and diethylaminoethyl methacrylate; and diene monomers, e.g. butadiene, isoprene, cyclohexene, acrylonitrile, methacrylonitrile, and acrylamide.

The use of a polar resin is essential for the formation of the core-shell structure in this embodiment. Examples of the polar resins used in this embodiment include nitrogen-containing polymers, such as dimethylaminoethyl methacrylate and diethylaminoethyl methacrylate; copolymers of styrene and unsaturated carboxylate esters; homopolymers of nitrile monomers such as acrylonitrile, halogenated monomers such as vinyl chloride, unsaturated carboxylic acids such as acrylic acid and methacrylic acid, unsaturated dibasic carboxylic acids, unsaturated dibasic carboxylic anhydrides, nitro-monomers, and copolymers of these monomers with styrene monomers; polyester resins; and epoxy resins. Among them, styrene-acrylic acid copolymers, maleic acid copolymers, saturated polyester resins, and epoxy resins are preferable.

Examples of initiators used in polymerization of these polar resins include azo and diazo initiators, e.g. 2,2'-azobis-(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; peroxides, e.g. benzoyl peroxide, methyl ethyl ketone peroxide, di-isopropyl peroxy carbonate, cumene hydroperoxide, tert-butyl hydroperoxide, di-tert-butyl peroxide, dicumyl peroxide, 2,4-dichloro benzoyl peroxide, lauroyl peroxide, 2,2-bis(4,4-tert-butyl peroxy cyclohexyl)propane, tris-(t-butyl peroxy)triazine; polymers having peroxy side chains; persulfates, e.g. potassium persulfate and ammonium persulfate; and hydrogen peroxide. The initiator is added in an amount of 0.5 to 20 percent by weight of the polymerizable monomer. The initiators may be used alone or in combination.

Known crosslinkers and chain transfer agents may be added in this embodiment to adjust the molecular weight of the polymer in an amount of 0.001 to 15 parts by weight.

It is preferable that the dispersing medium contains an inorganic or organic stabilizer in the production of the toner by emulsion, dispersion, suspension, seed polymerization, or hetero-aggregation polymerization. Examples of the inorganic stabilizers include calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. Examples of the organic stabilizers include polyvinyl alcohol, gelatin, methyl cellulose, methyl hydroxypropyl cellulose, ethyl cellulose, sodium salt of carboxymethyl cellulose, polyacrylic acid and salts thereof, starch, polyacrylamide, polyethylene oxide, hydroxystearic acid-g-methyl methacrylate-eu-methacrylic acid terpolymers, and cationic, anionic, ampholytic and nonionic surfactants.

In emulsion and hetero-aggregation polymerization, a cationic, anionic, ampholytic or nonionic surfactant is generally used as a stabilizer. The stabilizer is preferably added in an amount of 0.2 to 30 parts by weight to 100 parts by weight of the polymerizable monomer.

When using one of the above-mentioned inorganic stabilizers, the inorganic stabilizer is preferably formed in the dispersing medium in order to obtain a fine particulate stabilizer, although any commercial product may be used without modification.

A surfactant may be added in an amount of 0.001 to 0.1 parts by weight to maintain stable dispersion of the stabilizer in the dispersing medium. Examples of the surfactants include sodium dodecylbenzene sulfate, sodium tetradecyl sulfate, sodium pentadecyl sulfate, sodium octyl sulfate, sodium oleate, sodium laurate, potassium stearate, and calcium oleate.

In the polymerization toner production process, attention must be directed to polymerization inhibition by the coloring agent and migration to the aqueous phase of the coloring agent. It is preferable that the surface of the coloring agent be modified, and particularly subjected to hydrophobic treatment. Great attention must be directed to the use of dye and carbon black coloring agents, since they function as polymerization inhibitors. A preferred method for surface modification of a dye coloring agent is pre-polymerization of the monomer in the presence of the dye, and the resulting colored polymer is added to the monomer system. The carbon black may be treated by the same method as the dye or with a compound having the reverse polarity to the carbon black, for example, polyorganosiloxane.

In accordance with this embodiment as described above, the endless fixing film B with a high Young's modulus comprising the metal or resin substrate B1 and the releasing layer B2 thereon is fitted between the fixing roller R1 and the heating roller R3, and the pressurizing roller R2, which compresses the fixing roller RI through the fixing film B, is provided to form the nip section N between the fixing film B and the pressurizing roller R2. The guide G, which extends from the heating roller R3 and the nip section N, is provided under the fixing film B to form the linear heating passage P together with the fixing film B. The recording medium C and the toner C1 thereon are preheated in a noncontact state, and heated under pressure at the nip section N to fix the developed image on the recording medium C. Finally, the recording medium C is separated from the fixing film B. Since the spherical toner with high flowability is preheated in the heating passage, the toner is deformed and partly loses its flowability. Such decreased flowability prevents disorder of the image by the shock when the recording medium is introduced into the nip section N. When the toner encompassing the wax is used, preheating in the heating passage P helps bleeding of the wax. Thus, the temperature at the nip section can be reduced, resulting in a decreased heat-up time. Further, the toner is prevented from offset without application of oil on the fixing film. The fixing apparatus including such a configuration can form a full-color OHP image with high transparency.

Figure 8:
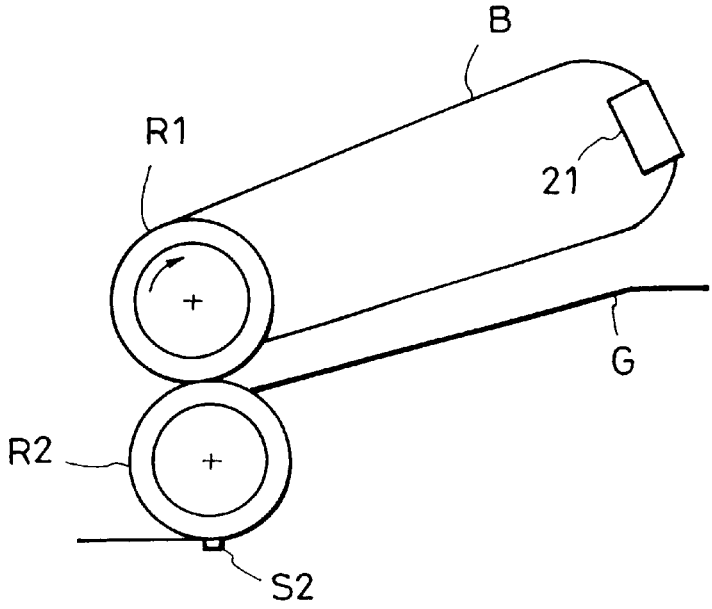
FIG. 8 is a schematic longitudinal cross-sectional view of another fixing apparatus in accordance with Embodiment 1.
Figure 9:
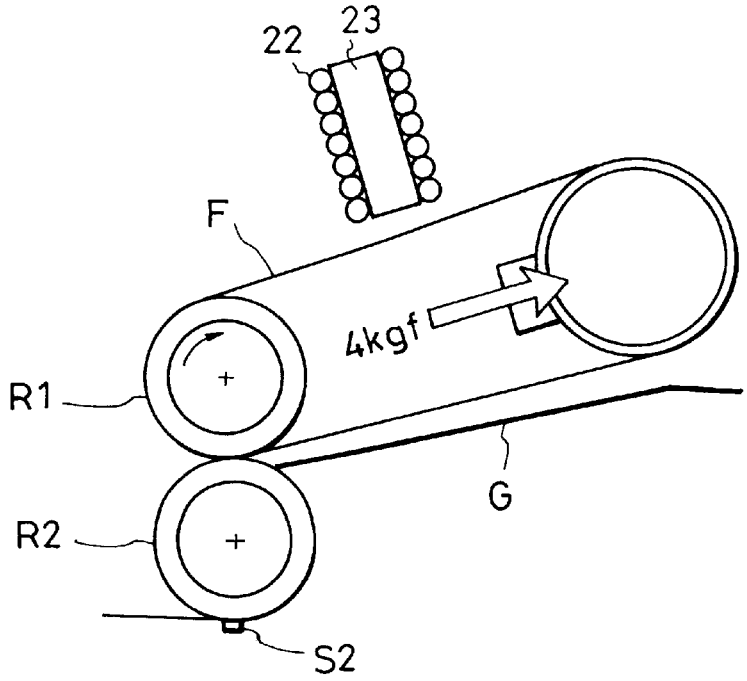
FIG. 9 is a schematic longitudinal cross-sectional view of a further fixing apparatus in accordance with Embodiment 1.

Although the above-described fixing apparatus has the heating roller R3 provided between the heater H1 and the fixing film B, the heater may directly heat the fixing film as shown in FIGS. 8 and 9. In the fixing apparatus shown in FIG. 8, the fixing film B is heated with a ceramic heater 21 provided with a resistance heater in contact with the fixing film. In the fixing apparatus shown in FIG. 9, a fixing film F, that is, a nickel electrocast belt is heated by a magnetic flux emerging from a coil 22 provided with a core 23.

Embodiment 2

Figure 10:
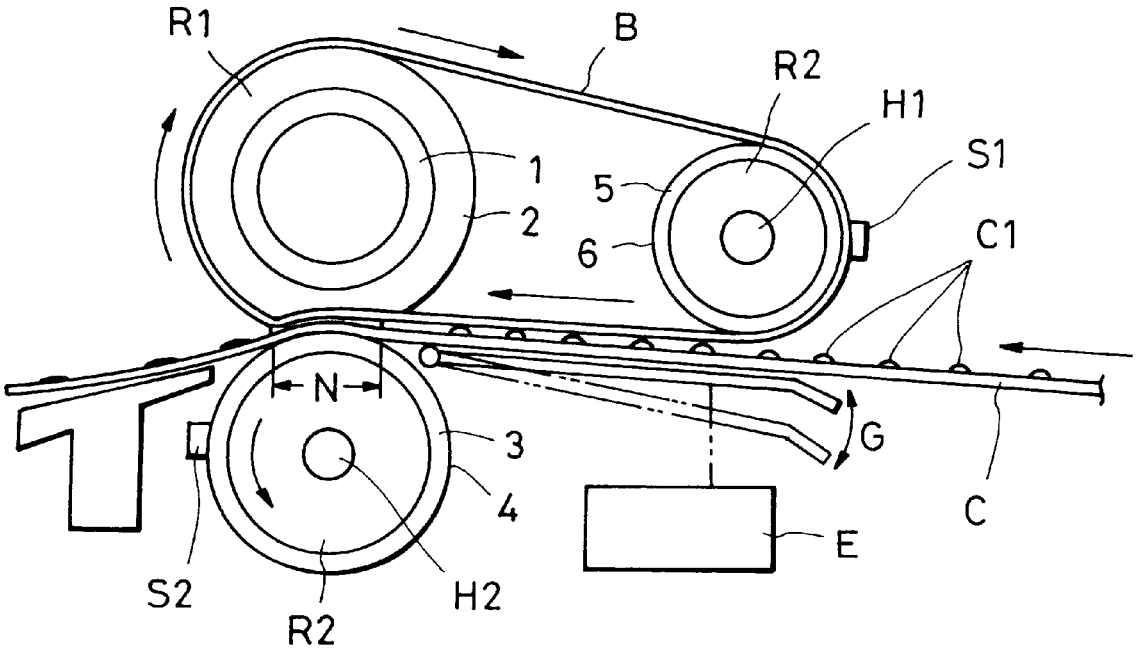
FIG. 10 is a schematic longitudinal cross-sectional view of a fixing apparatus in accordance with Embodiment 2.

FIG. 10 is a longitudinal cross-sectional view for illustrating Embodiment 2 in accordance with the present invention. In this embodiment, the distance between the recording medium C and the fixing film B can be varied. Parts having the same function as in Embodiment 1 are referred to with the same identification numbers, and a detailed description thereof with reference to drawings has been omitted. Such a configuration permits control of the heat applied to the recording medium C and the toner C1. For example, when the guide G is lifted upward to decrease the distance between the heater hl and the guide C, the recording medium C is more effectively heated, resulting in the formation of highly glossy images. In contrast, when the guide G is lowered, the resulting image has suppressed gloss because of decreased heating of the recording medium C. In FIG. 10, the guide G is moved upward and downward with a lift E to control the distance between the recording medium C carried on the guide G and the fixing film B. When a capsule toner is used, bleeding of the wax is easily controlled by the distance between the heater H1 and the guide G and thus gloss can be more easily controlled.

In this embodiment as described above, the gloss of the image on the recording medium C can be controlled by changing the distance between the heater H1 and the guide G without changing the fixing speed or the heat from the heater. The control of the gloss may be performed based on instructions by the operator or the results of a gloss detector, not shown in the drawing, which detects the gloss of a document to be copied. Also, the control may be performed based on the type, thickness or surface state of the recording medium. Further, the control may be performed based on the type of the formed image, that is, whether the formed image is a line image or not, or whether the formed image is composed of a singularity or a plurality of colors.

The movement of the guide G may be performed while a recording medium C passes through the heating passage P. For example, when the front end of the recording medium C passes through the heating paths P, the guide G is lowered, and the guide G is gradually lifted while the recording medium C passes through the heating passage P. Such movement of the guide G helps the formation of an image having uniform gloss over the recording medium C.

Figure 11:
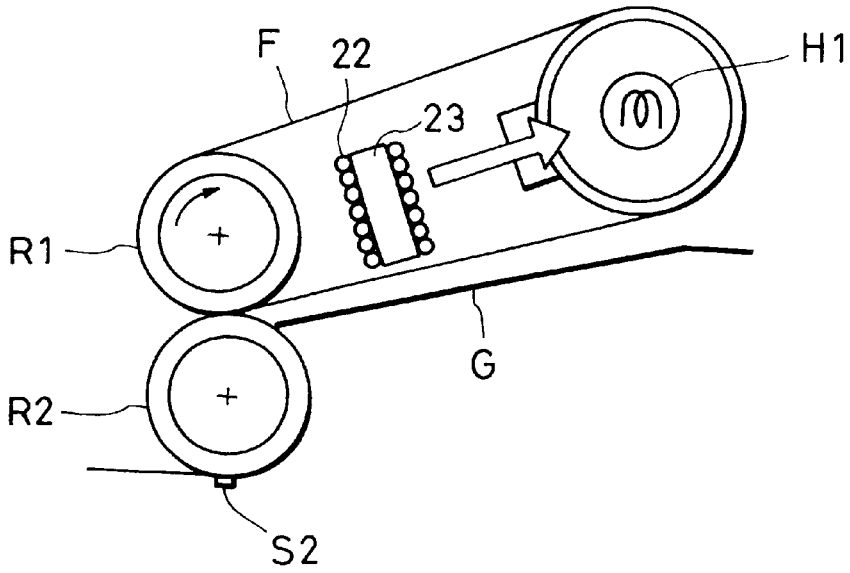
FIG. 11 is a schematic longitudinal cross-sectional view of another fixing apparatus in accordance with Embodiment 2.
Figure 12:
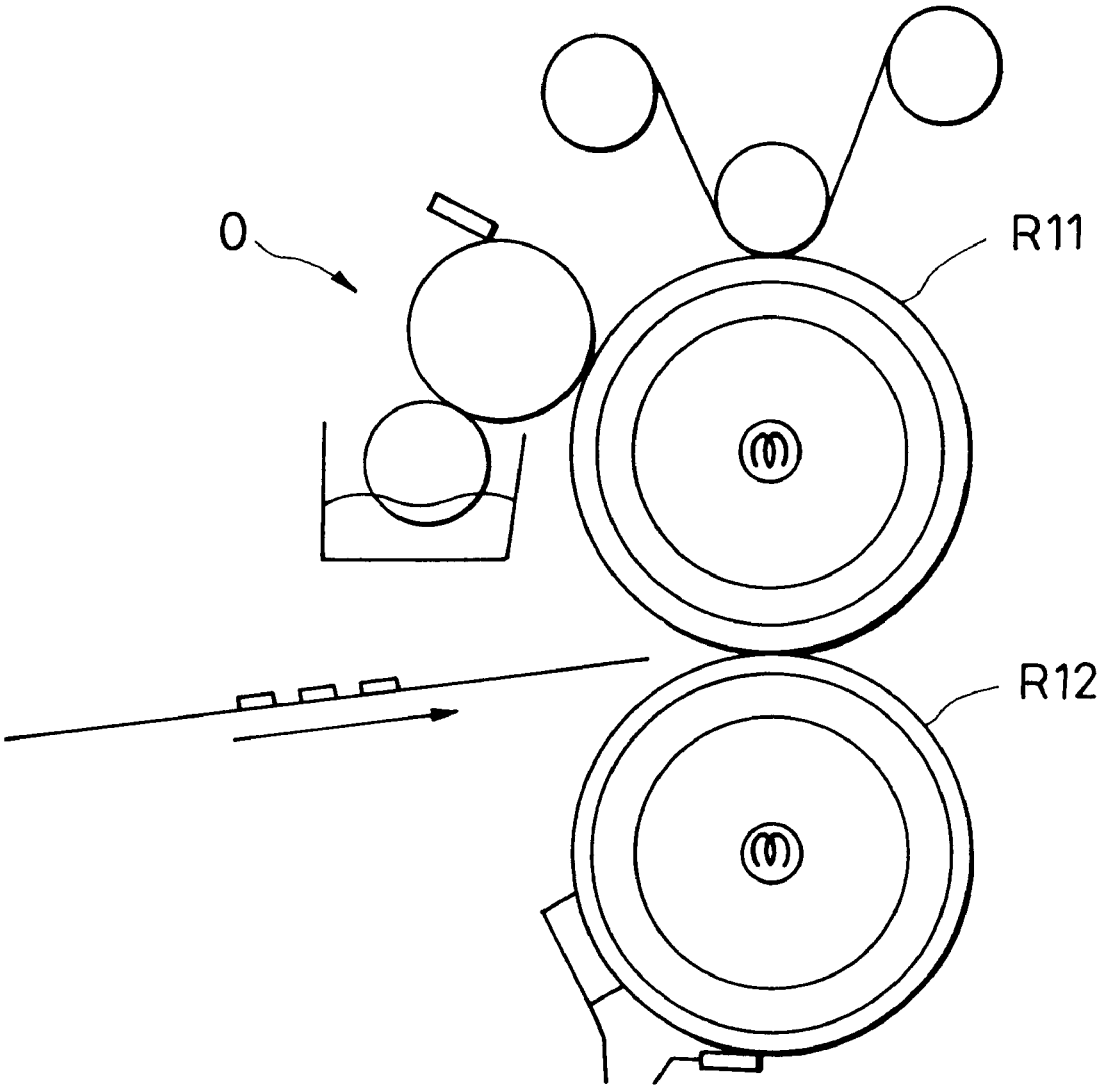
FIG. 12 is a schematic longitudinal cross-sectional view of a conventional fixing apparatus.

In the case of direct heating of the fixing film by a heater, as shown in FIG. 11, the heat applied to the recording medium C may also be controlled by moving the core 23 and the coil 22 with a controller not shown in the drawing, such as a solenoid. That is, the distance between the heater and the fixing film is controlled instead of controlling the distance between the heater 1 and the guide G, as described above.

Examples of the image forming apparatus in accordance with the present invention will now be described.

EXAMPLE 1

A fixing film B comprising a 40-$\mu$m nickel electrocast film and a 200-$\mu$m silicone rubber was mounted in a fixing apparatus, and a toner prepared as follows was used. Other configurations of the fixing apparatus are the same as in FIG. 1.

To 710 g of deionized water, 450 g of an aqueous 0.1-M $Na_3PO_4$ solution was added. The solution was heated to 60° C., and then stirred with a TK homomixer (made by Tokushukika Kogyo Co., Ltd.) at 13,000 rpm. To the solution, 68 g of an aqueous 1.0-M $CaCl_2$ solution was gradually added to form an aqueous dispersing medium containing $Ca_3(PO_4)_2$. A mixture based on the following formulation was heated to 60° C., and homogeneously dissolved and dispersed with the TK homomixer at 12,000 rpm:

Styrene 166 g n-Butyl acrylate 34 g

Phthalocyanine Blue 15 g

A metal salt of di-tert-butylsalicylic acid 3 g

Saturated polyester 467 g (acid value: 11, peak molecular weight: 8,500)

Monoester wax 40 g (Mw: 500, Mn: 400, viscosity: 6.5 mPas, SP value: 8-6)

Into the dispersion, 10 g of 2,2'-azobis(2,4-dimethylvaleronitrile) was dissolved as an initiator. The resulting polymerizable monomer composition was placed into the above-mentioned aqueous dispersing medium, and the mixture was stirred in a nitrogen atmosphere with the TK homomixer at 10,000 rpm for 20 min to form droplets of the polymerizable monomer composition. The dispersion was stirred with paddle wings at 80° C. for 10 hours to complete the reaction. The dispersion was cooled and hydrochloric acid was added to dissolve calcium phosphate. The dispersion was filtrated, washed with water, and dried.

To 100 parts by weight of the resulting cyan polymer particulate toner, 2 parts by weight of hydrophobic titanium oxide having a BET specific area of 100 $cm^2$ were added. A toner having an average particle size of 6.2 $\mu$m was prepared.

To 7 parts by weight of the toner, 93 parts by weight of a chronite carrier having a silicone coating layer with a thickness of 35 $\mu$m were added and mixed.

Toner images were fixed on plain paper under the following conditions while varying the temperature of each position in the apparatus:

Linear velocity: 133 m/s

Pressure applied to pressurizing roller R2: 66 kgf

Distance between fixing film B and guide G: 3 mm

The results of fixing characteristics are shown in Table 1.

TABLE 1

| Run | Temperature of heating roller (° C.) | Temperature of pressurizing roller (° C.) | Temperature of fixing film (° C.) At nip section | Temperature of fixing film (° C.) At outlet section | Fixing Property | Offset | Jam |
|---|---|---|---|---|---|---|---|
| 1 | 140 | 100 | 135 | 115 | B | A | None |
| 2 | 150 | 110 | 145 | 120 | A | A | None |
| 3 | 160 | 115 | 155 | 125 | A | A | None |
| 4 | 170 | 125 | 165 | 135 | A | A | None |
| 5 | 180 | 130 | 175 | 140 | A | A | None |
| 6 | 190 | 140 | 180 | 150 | A | B | None |

Fixing property & Offset: A (Excellent), B (Allowable), C (No good)
Remarks: Temperature of guide 100° C. to 130° C. (at a temperature of the heating roller of 170° C.)

EXAMPLE 2

Toner images were fixed onto plain paper as in Example 1 using a fixing apparatus R provided with a fixing film B comprising a 55-$\mu$m polyimide substrate and a 200-$\mu$m silicon rubber layer thereon. The results of fixing characteristics shown in Table 2.

TABLE 2

| Run | Temperature of heating roller (° C.) | Temperature of pressurizing roller (° C.) | Temperature of fixing film (° C.) At nip section | Temperature of fixing film (° C.) At outlet section | Fixing Property | Offset | Jam |
|---|---|---|---|---|---|---|---|
| 1 | 140 | 100 | 135 | 110 | B | A | None |
| 2 | 150 | 110 | 145 | 115 | A | A | None |
| 3 | 160 | 115 | 155 | 125 | A | A | None |
| 4 | 170 | 125 | 165 | 130 | A | A | None |
| 5 | 180 | 130 | 175 | 140 | A | A | None |
| 6 | 190 | 140 | 180 | 150 | A | B | None |

Fixing property & Offset: A (Excellent), B (Allowable), C (No good)
Remarks: Temperature of guide 100° C. to 130° C. (at a temperature of the heating roller of 170° C.)

EXAMPLE 3

A toner C1 was prepared as in Example 1 using a paraffin wax (Mw: 470, Mn: 380, viscosity: 6.8 mPas, SP value: 8-3) instead of the monoester wax in Example 1. Satisfactory results were obtained.

EXAMPLE 4

A toner C1 was prepared as in Example 1 using a diester wax (Mw: 480, Mn: 410, viscosity: 10.5 mPas, SP value: 9-1) instead of the monoester wax in Example 1. Satisfactory results were obtained.

EXAMPLE 5

A toner C1 was prepared as in Example 1 using a tetraester wax (Mw: 430, Mn: 380 with a shoulder peak at a molecular weight of 850, viscosity: 11.6 mPas, SP value: 8-5) instead of the monoester wax in Example 1. Satisfactory results were obtained.

EXAMPLE 6

A magenta toner, a yellow toner, and a black toner were prepared as in Example 1 using a quinacridone pigment, C.I. Pigment Yellow 180, and carbon black, respectively, instead of the copper phthalocyanine pigment. Light or pale colors were satisfactorily reproduced, and thus satisfactory images were obtained.

EXAMPLE 7

A magnetic toner C1 was prepared as in Example 1 using 200 g of magnetic iron oxide treated with a silane coupling agent (average particle size: 0.25 $\mu$m) and a hydrophobic silica. A satisfactory image was obtained.

Using each of the toners in Examples 1 to 7, the apparatus shown in FIG. 10 was operated while varying the distance of the heating passage P. Any toners can control gloss of the image. When the guide G is lowered, that is, when preheating is not positively performed, the gloss was decreased by 10 or more according to a 60-degree method.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fixing apparatus comprising:

fixing means for forming a nip to convey a recording member on which there is unfixed toner;

heating means for heating the toner on said recording member at a position upstream of said nip in a moving direction of the recording member;

a guide member coming into contact with the recording member holding the toner for guiding a movement of the recording member; and control means for controlling a distance between said heating means and said guide member in response to a condition of an image being formed on the recording member.

2. A fixing apparatus according to claim 1, wherein said guide member comes into contact with the rear face of said recording member not holding the unfixed toner and introduces said recording member into said nip.

3. A fixing apparatus according to claim 1, wherein said control means moves said guide member.

4. A fixing apparatus according to claim 1, wherein said control means controls the distance between said heating means and said guide member so that it is reduced when a plurality of color toners are held on said recording member compared with when a single color toner is held.

5. A fixing apparatus according to claim 1, wherein said control means controls the distance between said heating means and said guide member so that it is reduced when said heating means heats a front end of said recording member compared with the distance when said heating means heats a rear end of said recording member.

6. A fixing apparatus according to claim 1, wherein said heating means comprises a heating member, a rotor heated by said heating member, and said control means controls the distance between said heating member and said rotor.

7. A fixing apparatus according to claim 6, wherein said rotor does not come into contact with said recording member.

8. A fixing apparatus according to claim 7, wherein said rotor is an endless belt extending to form said nip together with said fixing means.

9. A fixing apparatus according to claim 8, wherein said fixing means comprises a pair of rollers, said endless belt being provided around one of said pair of rollers.

10. A fixing apparatus according to claim 6, wherein said control means controls the distance between said heating member and said guide member so that it is reduced when said heating means heats the front end of said recording member compared with the distance when said heating means heats the rear end of said recording member.

11. A fixing apparatus according to claim 1, wherein said control means controls the distance between said heating means and said guide member so that the distance is reduced when a plurality of color toners are held on said recording member compared with when a single color toner is held.

12. A fixing apparatus according to claim 1, wherein said control means controls the distance between said heating means and said guide member in response to a quantity of the toner held on said recording member.

13. A fixing apparatus according to claim 1 further comprising a detecting means for detecting a quantity of the toner, said control means controlling the distance between said heating means and said guide member in response to the output from said detecting means.

14. A fixing apparatus according to claim 1, wherein said control means controls the distance between said heating means and said guide member in response to the gloss of a document to be copied.

15. A fixing apparatus according to claim 1 further comprising a gloss detecting means for detecting the gloss of said recording member, said control means controlling the distance between said heating means and said guide member in response to the output from said gloss detecting means.

16. A fixing apparatus according to claim 1, further comprising another heating means for heating the toner on said recording member at the nip.

17. A fixing apparatus according to claim 1, wherein said fixing means comprises a pair of rollers compressing each other.

18. A fixing apparatus according to claim 1, wherein said toner comprises a toner formed by a polymerization process.

19. A fixing apparatus according to claim 1, wherein said toner has a shape factor SF-1 of 100 to 140 and a shape factor SF-2 of 100 to 130.

* * * * *

UNITED STATES PATENT AND TRADEMARK OFFICE

CERTIFICATE OF CORRECTION

PATENT NO. : 6,226,488 B1
DATED : May 1, 2001
INVENTOR(S) : Ryuichiro Maeyama

It is certified that error appears in the above-identified patent and that said Letters Patent is hereby corrected as shown below:

Title page,
Item [56], FOREIGN PATENT DOCUMENTS: "36-10231 5/1967" should read -- 36-10231 5/1961 --; "4-287078" should read -- 4-287077 --; and "5-3333643" should read -- 5-333643 --.

Column 4,
Lines 26 and 61, "II1" should read -- H1 --

Column 5,
Line 39, "(OIIT)" should read -- (OHT) --.
Line 58, "II2" should read -- H2 --, and "II1" should read -- H1 --.

Column 6,
Line 19, "IIitachi," should read -- Hitachi, --.

Column 8,
Line 61, "IIAAKE" should read -- HAAKE --.

Column 9,
Line 57, "COOII+$R_2$(OII)$_n$" should read -- COOH+$R_2$(OH)$_n$ --.

Column 13,
Line 59, "A" should read -- A --.

Column 15,
Line 24, "After" should read -- After --.

Signed and Sealed this

Eighth Day of January, 2002

*Attest:*

*Attesting Officer*

JAMES E. ROGAN
*Director of the United States Patent and Trademark Office*